US012768536B2

(12) United States Patent
Paller

(10) Patent No.: US 12,768,536 B2
(45) Date of Patent: Oct. 20, 2026

(54) OVEN APPLIANCE WITH FLAME PROVING

(71) Applicant: Haier US Appliance Solutions, Inc., Wilmington, DE (US)

(72) Inventor: Hans Juergen Paller, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 385 days.

(21) Appl. No.: 18/415,882

(22) Filed: Jan. 18, 2024

(65) Prior Publication Data

US 2025/0237385 A1 Jul. 24, 2025

(51) Int. Cl.

| | |
|---|---|
| ***F23N 5/24*** | (2006.01) |
| ***F23N 5/10*** | (2006.01) |
| ***F23N 5/14*** | (2006.01) |

(52) U.S. Cl.

CPC ..... *F23N 5/242* (2013.01); *F23N 5/102* (2013.01); *F23N 5/143* (2013.01); *F23N 2229/16* (2020.01); *F23N 2241/08* (2020.01)

(58) Field of Classification Search

CPC ..... F23N 5/102; F23N 5/143; F23N 5/242
USPC ..... 431/74
See application file for complete search history.

(56) References Cited

U.S. PATENT DOCUMENTS

| | | | | |
|---|---|---|---|---|
| 10,247,418 | B2 | 4/2019 | Bianchi et al. | |
| 2011/0126822 | A1* | 6/2011 | Barritt | F24C 3/126 126/39 BA |
| 2014/0212821 | A1 | 7/2014 | Banu et al. | |

FOREIGN PATENT DOCUMENTS

| | | | |
|---|---|---|---|
| EP | 3985306 | A1 | 4/2022 |
| GB | 2282221 | A1 * | 3/1995 |
| JP | 6494312 | B2 | 4/2019 |

OTHER PUBLICATIONS

"Thermocouple—Types, Construction, Working and Applications", Electrical Technology, https://www.electricaltechnology.org/2022/04/thermocouple-types-construction-working-applications.html, accessed Jan. 17, 2024, 23 pages.

Potter, David, "Measuring Temperature with Thermocouples—a Tutorial", National Instruments, The Software is the Instrument, Application Note 043, published Nov. 1996, 16 pages.

* cited by examiner

*Primary Examiner* — Vivek K Shirsat
(74) *Attorney, Agent, or Firm* — Dority & Manning, P.A.

(57) ABSTRACT

An oven appliance includes a cabinet and a chamber defined within the cabinet for receipt of food items for cooking. A gas burner is positioned in the cabinet, and a first temperature sensor is positioned proximate the gas burner. A second temperature sensor is distal from the first temperature sensor and the gas burner. The second temperature sensor is positioned and configured to measure a temperature in the chamber. A controller is positioned within the cabinet. The controller is configured for measuring a first temperature with the first temperature sensor, measuring a second temperature with the second temperature sensor, calculating a difference between the first temperature and the second temperature, and determining a flame is emanating from the gas burner in response to a positive difference between the first temperature and the second temperature.

20 Claims, 5 Drawing Sheets

OVEN APPLIANCE WITH FLAME PROVING

FIELD OF THE INVENTION

The subject matter of the present disclosure relates generally to an oven appliance, such as a full-size gas oven appliance or gas range appliance, and more specifically to systems and methods for flame proving in a gas oven appliance.

BACKGROUND OF THE INVENTION

Oven appliances generally include a cabinet that defines a cooking chamber for cooking food items therein, such as by baking or broiling the food items. To heat the cooking chamber for cooking, oven appliances include one or more heating elements positioned at a top portion, a bottom portion, or both the top portion and the bottom portion of the cooking chamber. Some oven appliances also include a convection heating element and fan for convection cooking cycles. The heating element or elements may be used for various cycles of the oven appliance, such as a preheat cycle, a cooking cycle, or a self-cleaning cycle.

Residential gas oven burner system have safety requirements regarding flame proving. Typical flame proving methods use flame rectification sensors that feed a signal into a control board that give the proper indication that the burner flame has been lit or not, however, flame rectification sensors and accompanying circuitry may be complex, expensive, and prone to being contaminated. Additionally, visual systems for flame proving may be easily soiled with food in an oven and prone to nuisance failures. Traditional thermocouple systems may also be too slow to respond in an oven that runs as high as eight hundred degrees Fahrenheit (800° F.).

Accordingly, an oven appliance that includes a simplified, cheaper, and faster flame proving system and related methods would be desirable.

BRIEF DESCRIPTION OF THE INVENTION

Aspects and advantages of the invention will be set forth in part in the following description, may be apparent from the description, or may be learned through practice of the invention.

In one example embodiment, an oven appliance is provided. The oven appliance includes a cabinet and a chamber within the cabinet for receipt of food items for cooking. The chamber is delineated by a plurality of walls including a bottom wall, a left side wall, and a right side wall. A gas burner is positioned within the chamber, and a first temperature sensor is positioned proximate the gas burner. A second temperature sensor is distal from the first temperature sensor and the gas burner. The second temperature sensor is positioned and configured to measure a temperature in the chamber. and a controller positioned within the cabinet and in data communication with the first temperature sensor and the second temperature sensor. The controller is configured for measuring a first temperature with the first temperature sensor, measuring a second temperature with the second temperature sensor, calculating a difference between the first temperature and the second temperature, and determining a flame is emanating from the gas burner in response to a positive difference between the first temperature and the second temperature.

In another example embodiment, a method of operating an oven appliance is provided. The oven appliance includes a cabinet, a chamber defined within the cabinet for receipt of food items for cooking, a gas burner positioned in the cabinet, and a controller positioned within the cabinet. The method includes measuring a first temperature with the first temperature sensor, measuring a second temperature with the second temperature sensor, calculating a difference between the first temperature and the second temperature, and determining a flame is emanating from the gas burner in response to a positive difference between the first temperature and the second temperature, without receiving a signal from a flame rectification sensor.

These and other features, aspects, and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
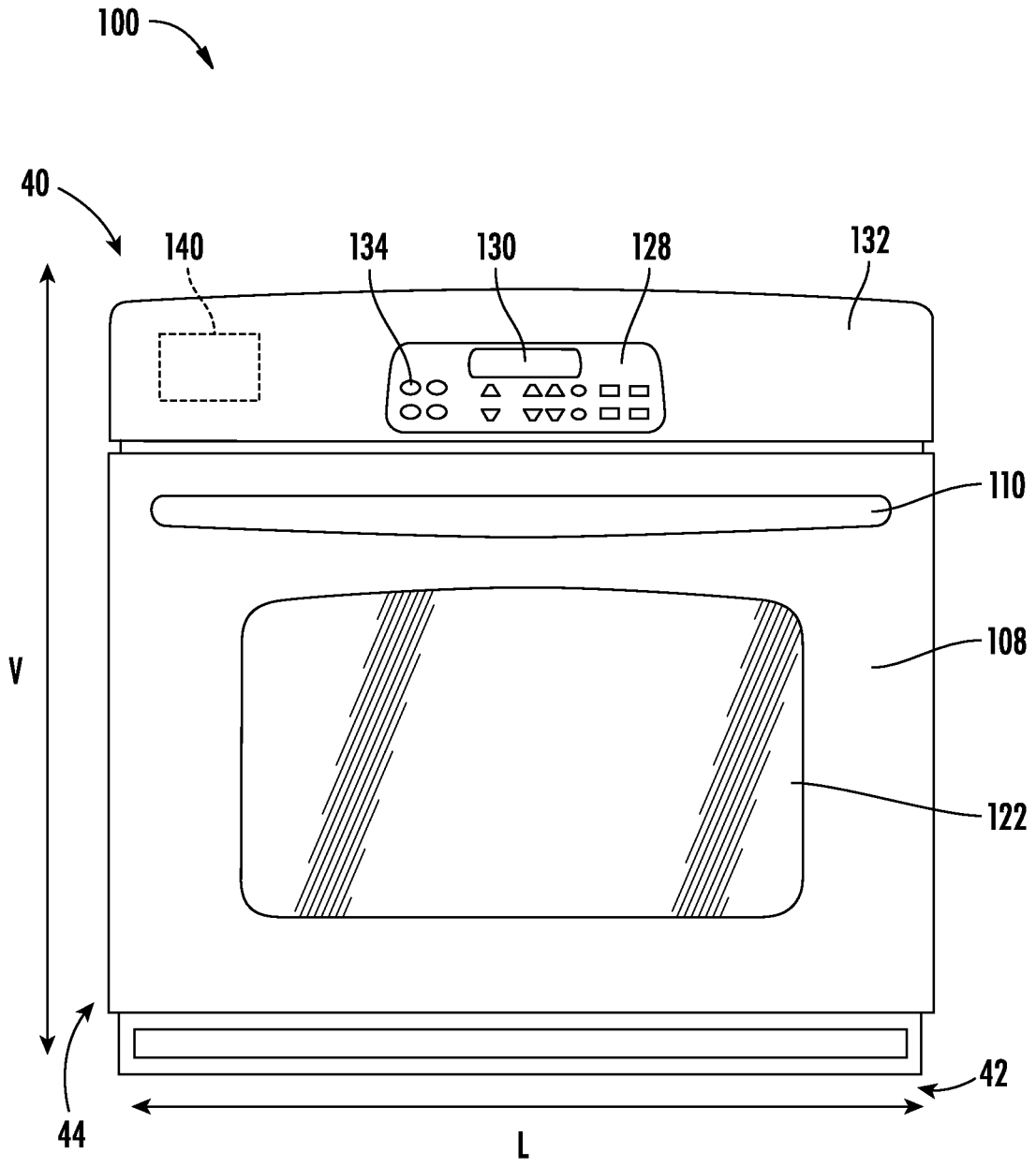
FIG. 1 provides a front view of an example oven appliance according to one or more embodiments of the present subject matter.

Repeat use of reference characters in the present specification and drawings is intended to represent the same or analogous features or elements of the present invention.

DETAILED DESCRIPTION OF THE INVENTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, terms of approximation, such as "generally," or "about" include values within ten percent greater or less than the stated value. In the context of an angle or direction, such terms include values within ten degrees of the stated direction. For example, "generally vertical" includes directions within ten degrees of vertical in any direction, e.g., clockwise or counter-clockwise.

Figure 2:
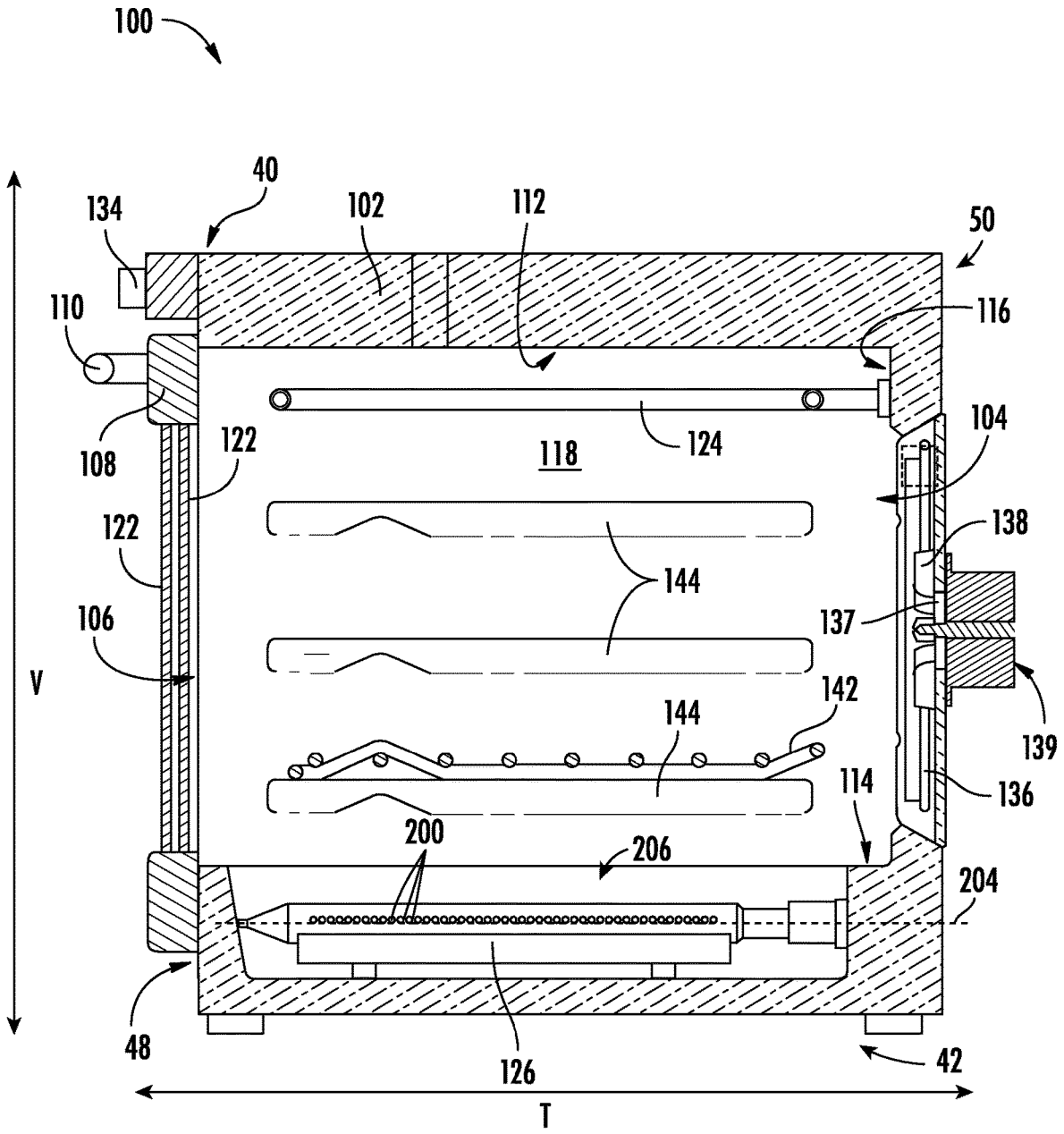
FIG. 2 provides a side section view of the oven appliance of FIG. 1.

FIGS. 1 and 2 illustrate an oven appliance 100 according to an example embodiment of the present subject matter. Oven appliance 100 includes an insulated cabinet 102 which defines a vertical direction V, a lateral direction L, and a transverse direction T. The vertical, lateral, and transverse directions V, L, and T are mutually perpendicular and form an orthogonal direction system. Cabinet 102 extends between a top portion 40 and a bottom portion 42 along the vertical direction V. Cabinet 102 extends between a left side 44 and a right side 46 along the lateral direction L and between a front portion 48 and a back portion 50 along the transverse direction T.

Still referring to FIGS. 1 and 2, for this example embodiment, oven appliance 100 includes an insulated cabinet 102 with an interior cooking chamber 104 defined by a top wall 112, a floor or bottom wall 114, a back wall 116, and a pair of opposing side walls 118. Cooking chamber 104 is configured for the receipt of one or more food items to be cooked. Oven appliance 100 includes a door 108 pivotally mounted to cabinet 102 at the opening 106 of cabinet 102 to permit selective access to cooking chamber 104 through opening 106. A handle 110 is mounted to door 108 and assists a user with opening and closing door 108. For example, a user can pull on handle 110 to open or close door 108 and access cooking chamber 104.

Oven appliance 100 can include a seal (not shown) between door 108 and cabinet 102 that assists with maintaining heat and cooking vapors within cooking chamber 104 when door 108 is closed as shown in FIGS. 1 and 2. Multiple parallel glass panes 122 provide for viewing the contents of cooking chamber 104 when door 108 is closed and assist with insulating cooking chamber 104. A baking rack 142 is positioned in cooking chamber 104 for the receipt of food items or utensils containing food items. Baking rack 142 is slidably received onto embossed ribs or sliding rails 144 such that rack 142 may be conveniently moved into and out of cooking chamber 104 when door 108 is open.

One or more heating elements may be included at the top, bottom, or both of cooking chamber 104 to provide heat to cooking chamber 104 for cooking. Such heating element(s) may be gas, electric, microwave, or a combination thereof. For example, in the embodiment shown in FIG. 2, oven appliance 100 includes a top heating element 124 which, in the illustrated example embodiment is an electric resistance heating element 124, and a bake heating element or bottom heating element 126, which, in the illustrated example embodiment of FIG. 2 is a gas burner 126. In the present example embodiment, gas burner 126 is positioned adjacent to and below bottom wall 114. For example, gas burner 126 may be positioned within a combustion chamber 206. In general, combustion chamber 206 may be an open space beneath bottom wall 114 where gas burner 126 is disposed such that gas burner 126 may be in thermal communication with cooking chamber 104. In some example embodiments, gas burner 126 may be positioned at back wall 116 or proximate top wall 112 of cooking chamber 104.

In the illustrated example embodiment, oven appliance 100 also has a convection heating element 136 and convection fan 138 positioned adjacent back wall 116 of cooking chamber 104. Convection fan 138 is powered by a convection fan motor 139. Further, convection fan 138 can be a variable speed fan-meaning the speed of fan 138 may be controlled or set anywhere between and including, e.g., zero and one hundred percent (0%-100%). In certain embodiments, oven appliance 100 may also include a bidirectional triode thyristor (not shown), i.e., a triode for alternating current (TRIAC), to regulate the operation of convection fan 138 such that the speed of fan 138 may be adjusted during operation of oven appliance 100. The speed of convection fan 138 can be determined by controller 140. In addition, a sensor 137 such as, e.g., a rotary encoder, a Hall effect sensor, or the like, may be included at the base of fan 138, for example, between fan 138 and motor 139 as shown in the example embodiment of FIG. 2, to sense the speed of fan 138. The speed of fan 138 may be measured in, e.g., revolutions per minute ("RPM"). In some embodiments, the convection fan 138 may be configured to rotate in two directions, e.g., a first direction of rotation and a second direction of rotation opposing the first direction of rotation. For example, in some embodiments, reversing the direction of rotation, e.g., from the first direction to the second direction or vice versa, may still direct air from the back of the cavity. As another example, in some embodiments reversing the direction results in air being directed from the top and/or sides of the cavity rather than the back of the cavity. Additionally, the convection heating features are optional and are shown and described herein solely by way of example. In additional embodiments, the oven appliance 100 may include different convection heating features or may not include convection heating features at all.

Oven appliance 100 may generally include a user interface 128 having a display 130 positioned on an interface panel 132 and having a variety of controls 134. Interface 128 allows the user to select various options for the operation of oven 100 including, e.g., various cooking and cleaning cycles. Operation of oven appliance 100 can be regulated by a controller 140 that is operatively coupled to, i.e., in communication with, user interface 128, heating elements 124, 126, and other components of oven 100 as will be further described.

For example, in response to user manipulation of the user interface 128, controller 140 can operate the heating element (s). Controller 140 can receive measurements from one or more temperature sensors, such as a first temperature sensor 210 (FIG. 3) and a second temperature sensor 212 (FIG. 3), which may be positioned in cooking chamber 104 or in combustion chamber 206. More specifically, the first temperature sensor 210 may be positioned proximate gas burner 126, and second temperature sensor 212 may be positioned distal, or away from, first temperature sensor 210. First temperature sensor 210 and second temperature sensor 212 will be described in further detail hereinbelow. Controller 140 may also provide information such as a status indicator, e.g., a temperature indication or a flame presence indication, to the user with display 130. Controller 140 can also be provided with other features as will be further described herein.

Controller 140 may include a memory and one or more processing devices such as microprocessors, CPUs, or the like, such as general or special purpose microprocessors operable to execute programming instructions or micro-control code associated with operation of oven appliance 100. The memory may represent random access memory such as DRAM or read only memory such as ROM or FLASH. In one embodiment, the processor executes programming instructions or methods stored in memory. The memory may be a separate component from the processor or may be included onboard within the processor. The memory can store information accessible by the processor(s), including instructions that can be executed by processor(s). For example, the instructions can be software or any set of instructions that when executed by the processor(s), cause the processor(s) to perform operations. For the embodiment depicted, the instructions may include a software package configured to operate the system, e.g., to execute example methods of operating the oven appliance 100. Controller 140 may also be or include the capabilities of either a proportional (P), proportional-integral (PI), or proportional-integral-derivative (PID) control for feedback-based control implemented with, e.g., temperature feedback from one or more sensors such as temperature sensors and/or probes, etc. For example, controller 140 may be configured for operating gas burner 126 in a closed-loop cooking operation based on temperature feedback from a main temperature sensor, such as temperature sensor 212 (FIG. 3), as will be described hereinbelow.

Controller 140 may be positioned in a variety of locations throughout oven appliance 100. In the illustrated embodiment, controller 140 is located next to user interface 128 within interface panel 132. In other embodiments, controller 140 may be located under or next to the user interface 128, otherwise within interface panel 132, or at any other appropriate location with respect to oven appliance 100.

Generally, controller 140 may be positioned within cabinet 102. In the embodiment illustrated in FIG. 1, input/output ("I/O") signals are routed between controller 140 and various operational components of oven appliance 100 such as heating elements 124, 126, 136, convection fan 138, controls 134, display 130, alarms, and/or other components as may be provided. In one embodiment, user interface 128 may represent a general purpose I/O ("GPIO") device or functional block.

Although shown with touch type controls 134 in FIG. 1, it should be understood that controls 134 and the configuration of oven appliance 100 shown in FIG. 1 is provided by way of example only. More specifically, user interface 128 may include various input components, such as one or more of a variety of electrical, mechanical, or electro-mechanical input devices including rotary dials, push buttons, and touch pads, e.g., such as a knob as illustrated in FIG. 2, among other possible examples and combinations. User interface 128 may include other display components, such as a digital or analog display device designed to provide operational feedback to a user. User interface 128 may be in communication with controller 140 via one or more signal lines or shared communication busses.

While oven 100 is shown as a wall oven, the present invention could also be used with other cooking appliances such as, e.g., a stand-alone oven, an oven with a stove-top, or other configurations of such ovens. Numerous variations in the oven configuration are possible within the scope of the present subject matter. For example, variations in the type and/or layout of the controls 134, as mentioned above, are possible. As another example, the oven appliance 100 may include multiple doors 108 instead of or in addition to the single door 108 illustrated. Such examples include a dual cavity oven, a French door oven, and others. The examples described herein are provided by way of illustration only and without limitation.

Referring specifically to FIG. 2, it may be seen that the gas burner 126 defines a generally cylindrical shape with a longitudinal axis 204 extending therethrough. The gas burner 126 also includes a plurality of ports 200 defined therein, e.g., in one or more linear arrays on one or more sides of the gas burner 126. As will be recognized and understood by those of ordinary skill in the art, the ports 200 orient and direct combustion products, e.g., flames and heated gases, from the gas burner 126, e.g., from within combustion chamber 206 to or towards the cooking chamber 104. In the example embodiment illustrated in FIG. 2, the gas burner 126 is oriented generally along the transverse direction T, e.g., the longitudinal axis 204 of the gas burner 126 is parallel to or within ten degrees of the transverse direction T.

Figure 3:
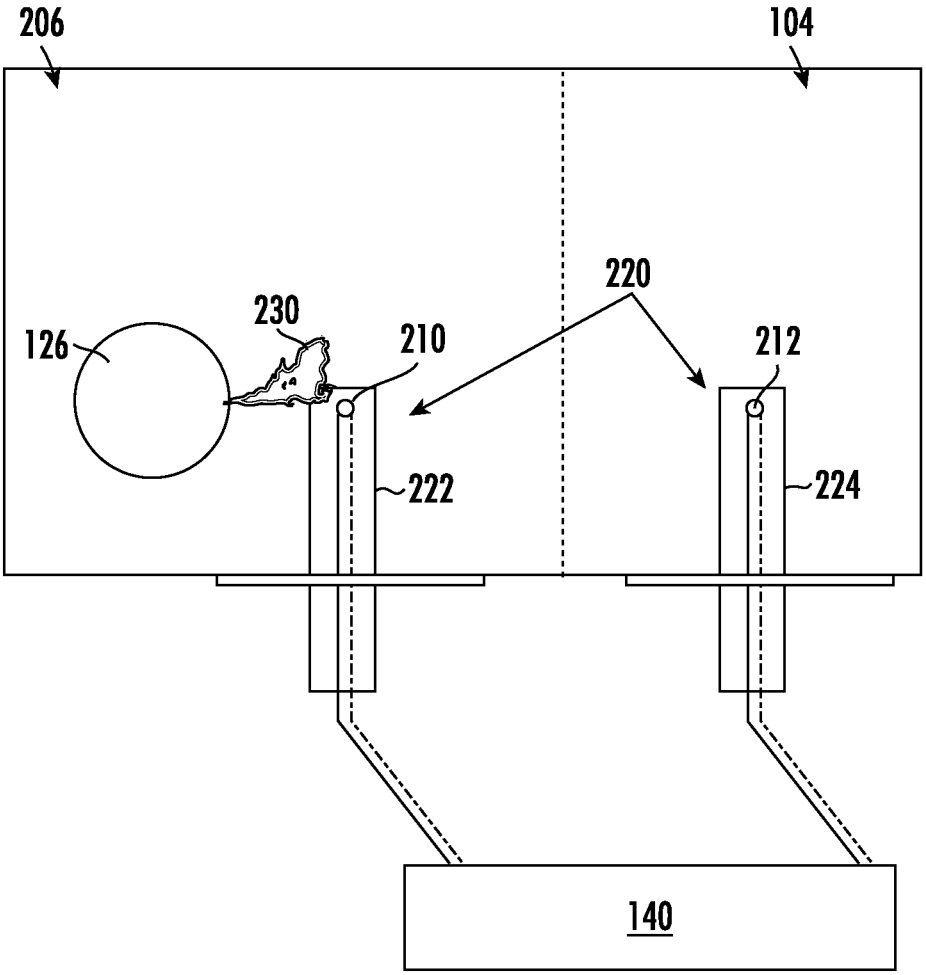
FIG. 3 provides a schematic view of an example configuration of the oven appliance of FIG. 1.
Figure 4:
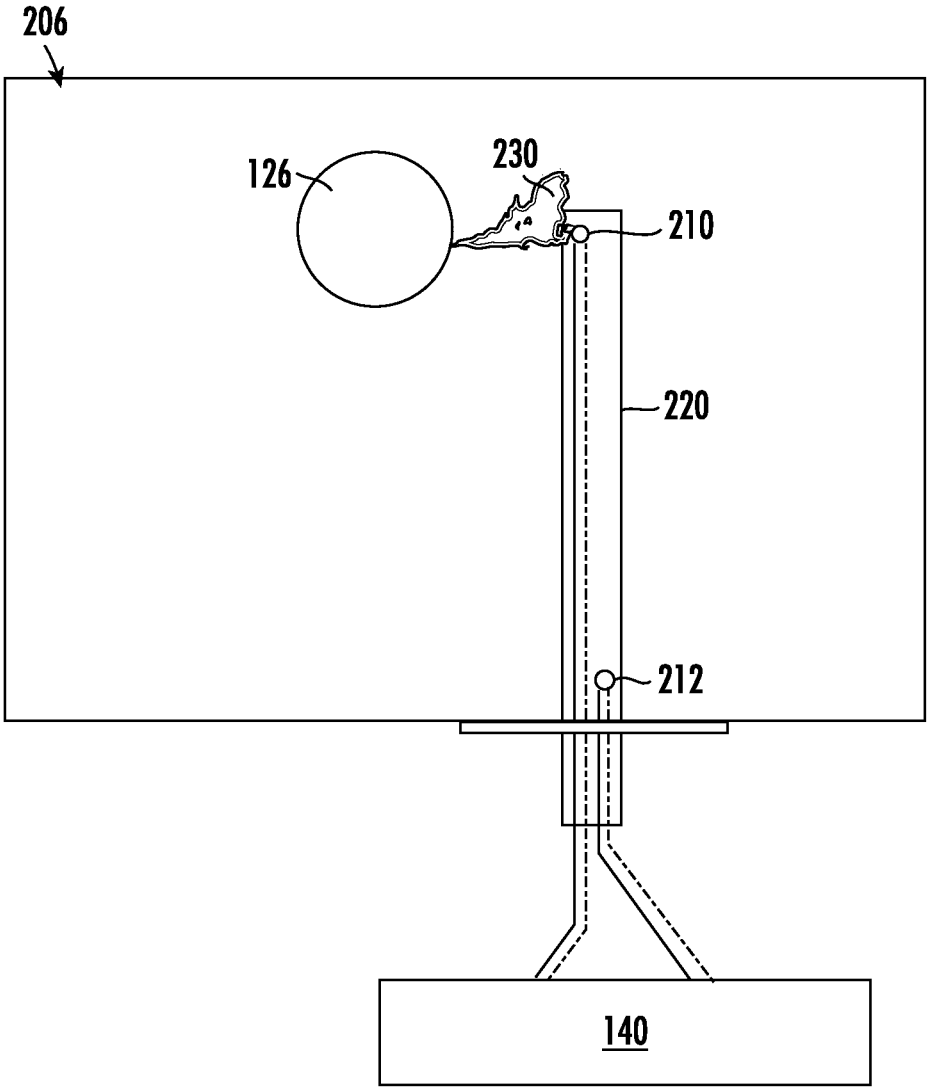
FIG. 4 provides a schematic view of an alternative example configuration of the oven appliance of FIG. 1.

Referring now to FIGS. 3 and 4, provided are schematic views of example configurations of the oven appliance of FIGS. 1 and 2 according to various embodiments of the present disclosure. More specifically, provided in FIG. 3 is a schematic showing the first temperature sensor 210 within combustion chamber 206 and the second temperature sensor 212 within cooking chamber 104. In particular, first temperature sensor 210 may be positioned proximate gas burner 126, such as within six inches (6 in), such as within four inches (4 in), such as within two inches (2 in) of the gas burner 126. In other words, first temperature sensor 210 may be positioned within, or close to, a flame(s) 230 exiting gas burner 126. In the present example embodiment, second temperature sensor 212 may be positioned within cooking chamber 104, e.g., second temperature sensor 212 may be distal, or spaced away, from first temperature sensor 210 and gas burner 126. For example, first temperature sensor 210 may measure a first temperature within, or close to, flame(s) 230 and second temperature sensor 212 may measure a second temperature which may be a general temperature of cooking chamber 104. As such, in some example embodiments, second temperature sensor 212 may be a main temperature sensor configured to provide controller 140 with the general temperature of the cooking chamber 104 during the closed-loop cooking operation. Accordingly, in some example embodiments, first temperature sensor 210 and/or second temperature sensor 212 may be positioned at back wall 116 or proximate top wall 112 of cooking chamber 104, such as proximate gas burner 126.

In another example embodiment, as illustrated in FIG. 4, is a schematic of both first temperature sensor 210 and the second temperature sensor 212 within combustion chamber 206. Similar to the previous example embodiment, first temperature sensor 210 may be positioned proximate gas burner 126, and second temperature sensor 212 may be distal, or spaced away, from first temperature sensor 210 and gas burner 126 within combustion chamber 206, such that flame(s) 230 do not directly influence the temperature measured by second temperature sensor 212.

In some example embodiments, both of first temperature sensor 210 and second temperature sensor 212 may be identical types of sensors. For example, both of first temperature sensor 210 and second temperature sensor 212 may be thermocouple sensors, or, in some additional/alternative embodiments, both of first temperature sensor 210 and second temperature sensor 212 may be resistance temperature detector (RTD) sensors. In some other example embodiments, first temperature sensor 210 and second temperature sensor 212 may be a combination of a thermocouple sensor and a RTD sensor, such as, first temperature sensor 210 may be an RTD sensor and second temperature sensor 212 may be a thermocouple sensor. Regardless of the type of sensor, first temperature sensor 210 and second temperature sensor 212 may be positioned within a probe sheath 220. In general, probe sheath 220 may provide additional protection to first temperature sensor 210 and second temperature sensor 212 against flame(s) 230, and/or undesired contamination within oven appliance 100. As shown in FIG. 3, first temperature sensor 210 may be positioned within a first probe sheath 222 and second temperature sensor 212 may be positioned within a second probe sheath 224. For example, second probe sheath 224 may be separate from and spaced apart from first probe sheath 222. Alternatively, as shown in FIG.

4, first temperature sensor 210 and second temperature sensor 212 may be within a single probe sheath, probe sheath 220.

In general, controller 140 may be in data communication with first temperature sensor 210 and second temperature sensor 212. In particular, first temperature sensor 210 and second temperature sensor 212 may transmit temperature data to controller 140, such that controller 140 may compare a difference between the temperatures of first temperature sensor 210 and second temperature sensor 212. For example, a positive difference in temperature between first temperature sensor 210 and second temperature sensor 212, e.g., controller 140 may be configured for determining the flame (s) 230 emanating from gas burner 126 in response to a positive difference in temperature from the second temperature from second temperature sensor 212 to the first temperature from first temperature sensor 210. Furthermore, controller 140 may be further configured for igniting gas burner 126 and waiting a predetermined amount of time after igniting gas burner 126 before calculating the difference between the first temperature and the second temperature. As such, determining flame(s) 230 is/are emanating from gas burner 126 may occur in response to the positive difference between the first temperature and the second temperature reaching a threshold temperature differential after a predetermined amount of time. Additionally, the threshold temperature differential may indicate flame(s) 230 emanating from gas burner 126 when the threshold temperature differential is reached within the predetermined amount of time.

For example, the threshold temperature differential may be between one hundred degrees Fahrenheit (100° F.) and two hundred degrees Fahrenheit (200° F.), such as between one hundred and twenty five degrees Fahrenheit (125° F.) and one hundred and seventy five degrees Fahrenheit (175° F.), such as about one hundred and fifty degrees Fahrenheit (150° F.). The predetermined amount of time may be between one second (1 s) and four seconds (4 s), such as between two seconds (2 s) and three seconds (3 s), or otherwise about four seconds (4 s). In other words, for the temperature sensors to indicate the presence of flames within oven appliance 100, first temperature sensor 210 and second temperature sensor 212 may reach the positive temperature difference of about one hundred and fifty degrees Fahrenheit (150° F.) within about four seconds (4 s).

As one skilled in the art will appreciate, the above described embodiments are used only for the purpose of explanation. Modifications and variations may be applied, other configurations may be used, and the resulting configurations may remain within the scope of the invention. For example, oven appliance 100 is provided by way of example only and aspects of the present subject matter may be incorporated into any other suitable oven appliance.

Figure 5:
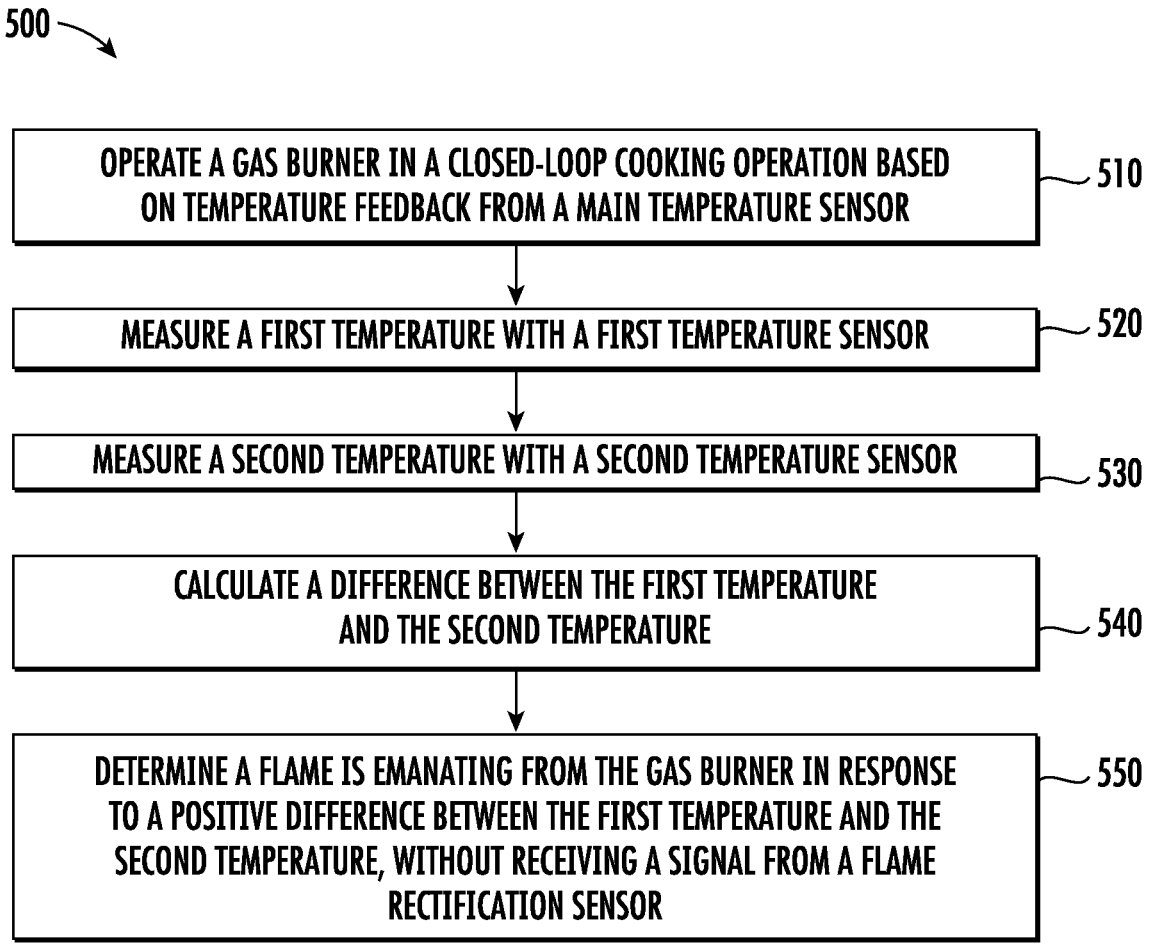
FIG. 5 provides a flow chart of an example method of operating an oven appliance according to aspects of the present disclosure.

Referring now to FIG. 5, a flow diagram of one embodiment of a method 500 of operating oven appliance 100 is illustrated in accordance with aspects of the present subject matter. In general, method 500 will be described herein with reference to the embodiments of oven appliance 100 and related elements described above with reference to FIGS. 1-4. However, it should be appreciated by those of ordinary skill in the art that the disclosed method 500 may generally be utilized in association with apparatuses and systems having any other suitable configuration. In addition, although FIG. 5 depicts steps performed in a particular order for purposes of illustration and discussion, the method discussed herein is not limited to any particular order or arrangement. One skilled in the art, using the disclosures provided herein, will appreciate that various steps of the method disclosed herein can be omitted, rearranged, combined, and/or adapted in various ways without deviating from the scope of the present disclosure.

As shown in FIG. 5, at (510), method 500 may generally include operating gas burner 126 in a closed-loop cooking operation based on temperature feedback from main temperature sensor 212. At (520), method 500 may generally include measuring the first temperature with the first temperature sensor 210. At (530), method 500 may generally include measuring a second temperature with a second temperature sensor 212, the main temperature sensor of oven appliance 100. At (540), method 500 may generally include calculating the difference between the first temperature and the second temperature. And, at (550), method 500 may generally include determining flame(s) 230 is/are emanating from gas burner 126 in response to the positive difference between the first temperature and the second temperature. In the present example embodiment, determining flame(s) 230 is/are emanating from gas burner 126 may occur without receiving a signal from a flame rectification sensor.

As may be seen from the above, an oven appliance may include a gas burner system, wherein the oven appliance may include two temperature sensors located inside a cabinet in order to detect flame(s). The sensors may be arranged in such a manner that one sensor remains close to the flame(s) of the gas burner, whereas the other sensor may be positioned away from the flame, but at a location where a general oven temperature may be measured. The sensors could be two separate probes, or two temperature sensors combined into one probe, wherein one of the sensors may be the main oven temperature control sensor and is supplemented with the other sensor which may be positioned close to the flame(s).

This written description uses examples to disclose the invention, including the best mode, and also to enable any person skilled in the art to practice the invention, including making and using any devices or systems and performing any incorporated methods. The patentable scope of the invention is defined by the claims and may include other examples that occur to those skilled in the art. Such other examples are intended to be within the scope of the claims if they include structural elements that do not differ from the literal language of the claims or if they include equivalent structural elements with insubstantial differences from the literal language of the claims.

What is claimed is:

1. An oven appliance, comprising:

a cabinet;

a chamber defined within the cabinet for receipt of food items for cooking, the chamber delineated by a plurality of walls including a bottom wall, a left side wall, and a right side wall;

a gas burner positioned within the chamber;

a first temperature sensor positioned proximate the gas burner;

a second temperature sensor distal from the first temperature sensor and the gas burner, the second temperature sensor positioned and configured to measure a temperature in the chamber, wherein the first temperature sensor is positioned beneath the bottom wall of the chamber, and the second temperature sensor is positioned within the chamber; and a controller positioned within the cabinet, the controller in data communication with the first temperature sensor and the second temperature sensor;

wherein the controller is configured for:

measuring a first temperature with the first temperature sensor;

measuring a second temperature with the second temperature sensor;

calculating a difference between the first temperature and the second temperature; and determining a flame is emanating from the gas burner in response to a positive difference between the first temperature and the second temperature.

2. The oven appliance of claim 1, wherein both of the first temperature sensor and the second temperature sensor are thermocouple sensors, resistance temperature detector sensors, or a combination of a thermocouple sensor and a resistance temperature detector sensor.

3. The oven appliance of claim 1, wherein the first temperature sensor and the second temperature sensor are both positioned within a single probe sheath.

4. The oven appliance of claim 1, wherein the first temperature sensor is positioned within a first probe sheath, and the second temperature sensor is positioned within a second probe sheath, the second probe sheath separate from and spaced apart from the first probe sheath.

5. The oven appliance of claim 1, wherein the first temperature sensor and the second temperature sensor are positioned within the chamber.

6. The oven appliance of claim 1, wherein the controller is configured for determining the flame is emanating from the gas burner in response to the positive difference between the first temperature and the second temperature reaching a threshold temperature differential between the first temperature sensor and the second temperature sensor.

7. The oven appliance of claim 6, wherein the controller is further configured for igniting the gas burner, waiting a predetermined amount of time after igniting the gas burner before calculating the difference between the first temperature and the second temperature, and for determining the flame is emanating from the gas burner in response to the positive difference between the first temperature and the second temperature reaching the threshold temperature differential after the predetermined amount of time.

8. The oven appliance of claim 7, wherein the threshold temperature differential comprises about one hundred and fifty degrees Fahrenheit.

9. The oven appliance of claim 7, wherein the predetermined amount of time comprises about four seconds.

10. A method for operating an oven appliance, the oven appliance comprising a cabinet, a chamber defined within the cabinet for receipt of food items for cooking, a gas burner positioned in the cabinet, and a controller positioned within the cabinet, the method comprising:

operating, by the controller, the gas burner in a closed-loop cooking operation based on temperature feedback from a main temperature sensor measuring a first temperature with a first temperature sensor;

measuring a second temperature with a second temperature sensor, wherein the second temperature sensor is the main temperature sensor of the oven appliance, wherein the first temperature sensor is positioned beneath the chamber of the cabinet, and the second temperature sensor is positioned within the chamber;

calculating a difference between the first temperature and the second temperature; and determining a flame is emanating from the gas burner in response to a positive difference between the first temperature and the second temperature, without receiving a signal from a flame rectification sensor.

11. The method of claim 10, wherein both of the first temperature sensor and the second temperature sensor are thermocouple sensors, resistance temperature detector sensors, or a combination of a thermocouple sensor and a resistance temperature detector sensor.

12. The method of claim 10, wherein the first temperature sensor and the second temperature sensor are both positioned within a single probe sheath.

13. The method of claim 10, wherein the first temperature sensor is positioned within a first probe sheath, and the second temperature sensor is positioned within a second probe sheath, the second probe sheath separate from and spaced apart from the first probe sheath.

14. The method of claim 10, wherein the first temperature sensor and the second temperature sensor are positioned within the chamber of the cabinet.

15. The method of claim 10, wherein the controller is configured for determining the flame is emanating from the gas burner in response to the positive difference between the first temperature and the second temperature reaching a threshold temperature differential between the first temperature sensor and the second temperature sensor.

16. The method of claim 15, further comprising, igniting the gas burner, waiting a predetermined amount of time after igniting the gas burner before calculating the difference between the first temperature and the second temperature, and determining the flame is emanating from the gas burner in response to the positive difference between the first temperature and the second temperature reaching the threshold temperature differential after the predetermined amount of time.

17. The method of claim 16, wherein the threshold temperature differential comprises about one hundred and fifty degrees Fahrenheit.

18. The method of claim 16, wherein the predetermined amount of time comprises about four seconds.

19. An oven appliance, comprising:

a cabinet;

a chamber defined within the cabinet for receipt of food items for cooking, the chamber delineated by a plurality of walls including a bottom wall, a left side wall, and a right side wall;

a gas burner positioned within the chamber;

a first temperature sensor positioned proximate the gas burner;

a second temperature sensor distal from the first temperature sensor and the gas burner, the second temperature sensor positioned and configured to measure a temperature in the chamber; and a controller positioned within the cabinet, the controller in data communication with the first temperature sensor and the second temperature sensor;

wherein the controller is configured for:

measuring a first temperature with the first temperature sensor;

measuring a second temperature with the second temperature sensor;

calculating a difference between the first temperature and the second temperature; and determining a flame is emanating from the gas burner in response to a positive difference between the first temperature and the second temperature, wherein the controller is configured for determining the flame is emanating from the gas burner in response to the positive difference between the first temperature and the second temperature reaching a threshold temperature differential between the first temperature sensor and the second temperature sensor, wherein the controller is further configured for igniting the gas burner, waiting a predetermined amount of time after igniting the gas burner before calculating the difference between the first temperature and the second temperature, and for determining the flame is emanating from the gas burner in response to the positive difference between the first temperature and the second temperature reaching the threshold temperature differential after the predetermined amount of time, and wherein the threshold temperature differential comprises about one hundred and fifty degrees Fahrenheit.

20. The oven appliance of claim 19, wherein the predetermined amount of time comprises about four seconds.

* * * * *